United States Patent [19]

Stetler, Jr. et al.

[11] Patent Number: 4,834,554

[45] Date of Patent: May 30, 1989

[54] PLASTIC BAG WITH INTEGRAL VENTING STRUCTURE

[75] Inventors: William D. Stetler, Jr., Hamburg; Theodore Davis, Snyder, both of N.Y.

[73] Assignee: J. C. Brock Corp., Buffalo, N.Y.

[21] Appl. No.: 121,068

[22] Filed: Nov. 16, 1987

[51] Int. Cl.[4] ..... B65D 33/01

[52] U.S. Cl. ..... 383/100; 426/118

[58] Field of Search ..... 383/100, 102, 103; 426/118, 415, 429

[56] References Cited

U.S. PATENT DOCUMENTS

| | | | |
|---|---|---|---|
| 1,018,812 | 2/1912 | Dujardin . | |
| 2,689,678 | 9/1954 | Wendt | 229/53 |
| 3,149,772 | 9/1964 | Olsson | 229/62 |
| 3,281,060 | 10/1966 | Heimos et al. | 229/62.5 |
| 3,302,859 | 2/1967 | Perry | 229/53 |
| 3,370,780 | 2/1968 | Shaw | 229/62.5 |
| 3,399,822 | 9/1968 | Kugler | 229/62.5 |
| 3,439,869 | 4/1969 | Shrum et al. | 229/62 |
| 3,502,487 | 3/1970 | Byrd | 383/100 |
| 3,516,217 | 6/1970 | Gildersleeve | 383/100 |
| 3,595,467 | 7/1971 | Goglio | 229/62.5 |
| 3,715,855 | 2/1973 | Armstrong | 53/37 |
| 3,851,440 | 12/1974 | Horsky | 53/34 |
| 3,877,197 | 4/1975 | Cayton et al. | 53/22 |
| 4,001,443 | 1/1977 | Dové | 426/415 |
| 4,224,347 | 9/1980 | Woodruff | 926/415 |
| 4,423,080 | 12/1983 | Bedrosion | 426/118 |
| 4,503,561 | 3/1985 | Bruno | 383/102 |
| 4,516,385 | 5/1985 | Lenker et al. | 53/504 |
| 4,525,983 | 7/1985 | Libow | 53/463 |

FOREIGN PATENT DOCUMENTS

| | | | |
|---|---|---|---|
| 2224356 | 10/1974 | France | 383/100 |
| 2141688 | 1/1985 | United Kingdom | 383/100 |

*Primary Examiner*—Stephen P. Garbe
*Attorney, Agent, or Firm*—Joseph P. Gastel

[57] ABSTRACT

A plastic bag having a venting structure therein including flexible plastic front and rear walls sealed along their side edges and a venting sealing arrangement at one end of the walls including elongated spaced heat-sealed portions having puckers formed therebetween and unsealed openings proximate the sealed portions to permit pressurized gases from within the bag to pass through the unsealed openings and the puckered portions to the atmosphere, the puckered portions normally maintaining the portions of the side walls which form the puckers in contiguous contacting engagement to function as normally closed valves which prevent atmospheric air from entering the bag. The bag may have one or both walls fabricated from polyethylene containing ethyl vinyl acetate which permits the bag to have controlled breathing to permit oxygen to enter the bag at a controlled rate to maintain freshness of the product.

2 Claims, 1 Drawing Sheet

Fig. 1.
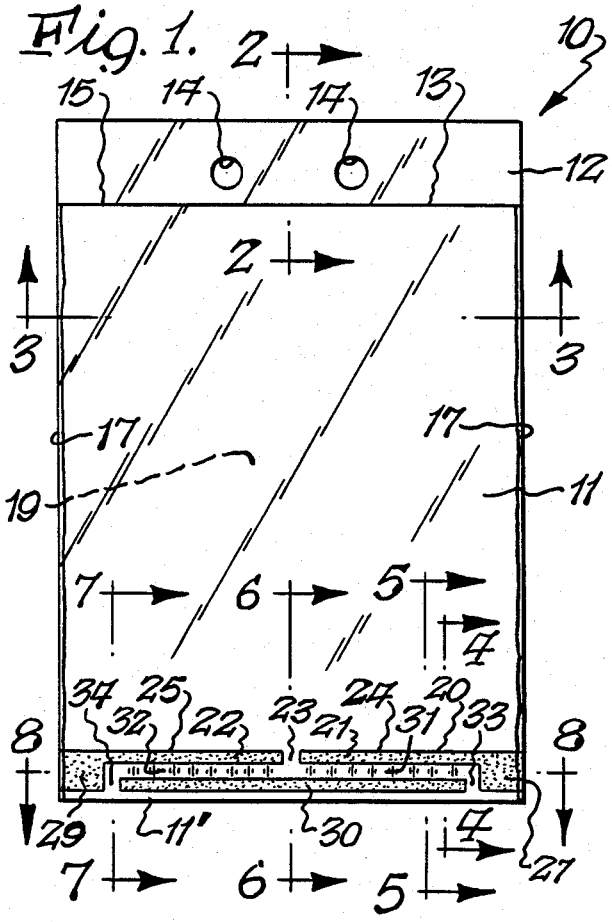
Fig. 2.
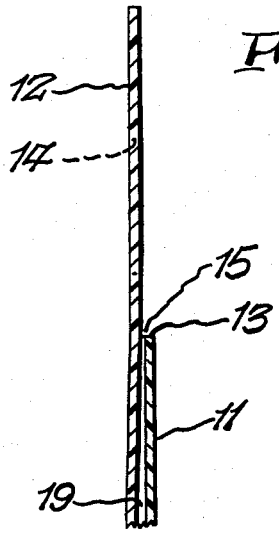
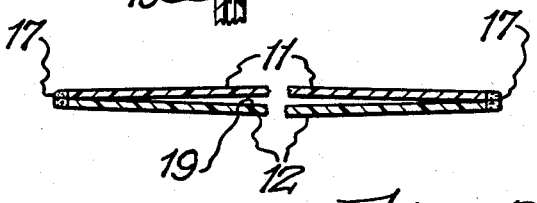
Fig. 3.
Fig. 4.
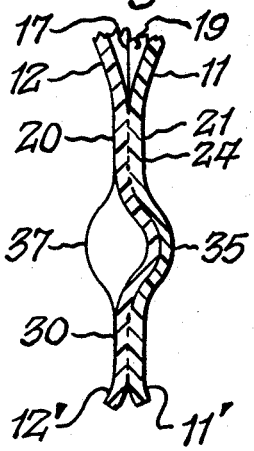
Fig. 5.
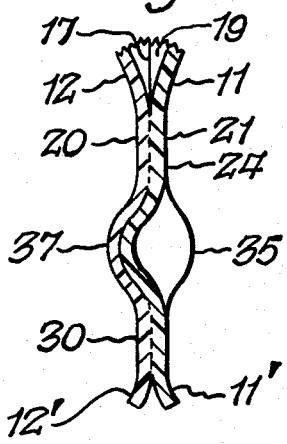
Fig. 6.
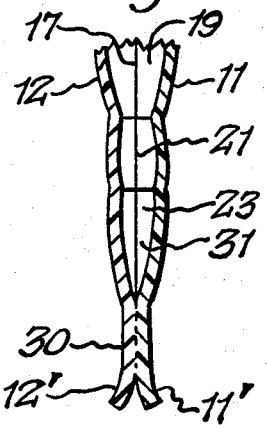
Fig. 7.
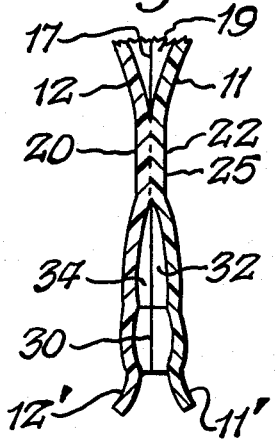
Fig. 8.
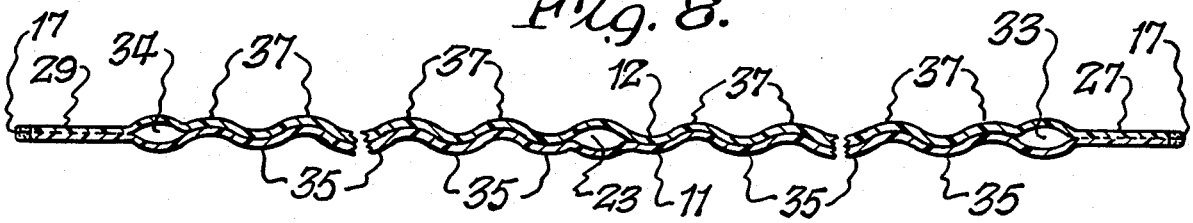

PLASTIC BAG WITH INTEGRAL VENTING STRUCTURE

BACKGROUND OF THE INVENTION

The present invention relates to a plastic bag for containing produce or other food products and which includes an improved valve structure which permits the bag to be vented without permitting atmospheric air to enter the bag or which also includes a wall structure which permits atmospheric air to enter the bag at a controlled rate to maintain product freshness.

By way of background, certain green leafy vegetables, such as cabbage and lettuce, are frequently shredded and placed in polyethylene bags for sale. There are enzymes in such produce which use oxygen within the bag and give off carbon dioxide which bloats the bag. In the past, holes have been placed in the bag walls to let out the carbon dioxide. However, this admits atmospheric air with unlimited amounts of oxygen which causes browning of the cut surfaces of the vegetables due to excessive oxidation, and thus the produce will tend to decay and lose its flavor and give off odors. Thus, two objectionable situations existed. If the bag did not have holes in it, it would bloat and become unsightly. If it did have holes in it, the produce would spoil. In addition, with the event of microwaving, products which may not necessarily bloat the bag during storage, are sold in plastic bags for microwaving purposes. However, such bags, if not suitably vented, would be bloated and rupture during microwaving because of the generation of gases.

SUMMARY OF THE INVENTION

It is accordingly the primary object of the present invention to provide a plastic bag having an improved venting structure therein which prevents atmospheric air from entering the bag but permits gases generated within the bag to be vented to the atmosphere, thereby making it manifestly suitable for packaging products which should not be exposed to atmospheric air but which generate gases either normally or when being microwaved.

Another object of the present invention is to provide an improved bag which not only has improved venting structure, but which also has walls which permit controlled breathing of oxygen from the atmosphere for maintaining freshness of produce having cut edges. Other objects and attendant advantages of the present invention will readily be perceived hereafter.

The present invention relates to a plastic bag with integral venting structure therein comprising flexible plastic front and rear walls having side edges and ends, means sealing said front and rear walls along said side edges, and venting sealing means joining said front and rear walls, said venting sealing means comprising spaced first and second sealed portions defining conduit means therebetween, first and second unsealed portions associated with said first and second sealed portions, respectively, at opposite ends of said conduit means, and pucker means formed by said front and rear walls in said conduit means and causing said front and rear walls between said first and second sealed areas to lie in contiguous contacting engagement and to thus function as normally closed valve means which prevent atmospheric air from entering said bag through said conduit means but which will open to permit pressurized gases to be vented from said bag through said first and second unsealed portions and said conduit means. In certain circumstances it may be desirable to have one or both walls made of polyethylene containing ethyl vinyl acetate to permit controlled breathing therethrough for entry of oxygen from the atmosphere.

The various aspects of the present invention will be more fully understood when the following portions of the specification are read in conjunction with the accompanying drawings wherein:

BRIEF DESCRIPTION OF THE DRAWINGS

FIG. 1 is a plan view of the front of the improved plastic bag of the present invention;

FIG. 2 is an enlarged fragmentary cross sectional view taken substantially along line 2—2 of FIG. 1 and showing the mouth end of the bag;

FIG. 3 is an enlarged fragmentary cross sectional view taken substantially along line 3—3 of FIG. 1 and showing the sealed side edges between the front and rear walls of the bag;

FIG. 4 is an enlarged fragmentary cross sectional view taken substantially along line 4—4 of FIG. 1 and showing a pucker between the two elongated sealed areas;

FIG. 5 is an enlarged fragmentary cross sectional view taken substantially along line 5—5 of FIG. 1 and showing a pucker which is adjacent to the pucker of FIG. 4;

FIG. 6 is an enlarged fragmentary cross sectional view taken substantially along line 6—6 of FIG. 1 and showing the unsealed portion associated with the upper elongated sealed area;

FIG. 7 is an enlarged fragmentary cross sectional view taken substantially along line 7—7 of FIG. 1 and showing the unsealed portion associated with the lower elongated sealed area; and FIG. 8 is an enlarged fragmentary cross sectional view taken substantially along line 8—8 of FIG. 1 and showing the various puckers in the conduit between the upper and lower elongated sealed areas and also showing the unsealed portions associated with the lower sealed area.

DESCRIPTION OF THE PREFERRED EMBODIMENTS

The improved plastic bag 10 includes valve structure which permits gases generated by the contents, such as produce, to be vented to the atmosphere while preventing atmospheric air, which may deteriorate the produce from entering the sealed bag. The improved bag 10 is also intended to contain a product which can be microwaved in the sealed bag which includes vent structure for permitting gases generated during the microwaving to be vented to the atmosphere, thereby avoiding the bursting of the bag.

The improved bag 10 includes a relatively thin flexible plastic front wall 11 and a relatively thin flexible plastic rear wall 12 which extends upwardly beyond the upper edge 13 of front wall 11. Walls 11 and 12 are preferably polyethylene. A pair of holes 14 are located in wall portion 12 for mounting bag 10 on a wicket bar normally associated with automatic bagging machinery. The bag 10 includes a mouth 15 proximate upper edge 13 through which product is inserted into the bag which is thereafter sealed along a horizontal line proximate upper edge 13. Front and rear walls 11 and 12, respectively, are sealed to each other at seams 17 along their side edges. The walls 11 and 12 provide a central chamber 19 into which product is placed.

A unique sealing arrangement is provided for sealing the bottom portions of walls 11 and 12 to each other by means of a heat seal. A first elongated heat-sealed area 20 is provided consisting of parts 21 and 22 with an unsealed portion 23 therebetween. Heat-sealed portions 21 and 22 comprise elongated horizontal portions 24 and 25, respectively, having depending sealed portions 27 and 29, respectively, at their outer ends. A second elongated heat-sealed portion 30 is located in spaced relationship below horizontal heat-sealed portions 24 and 25 to define conduits 31 and 32 therebetween. An unsealed portion 33 is located between sealed portion 27 and the end of sealed portion 30. A second unsealed portion 34 is located between sealed portion 29 and the end of sealed portion 30. Thus, unsealed portions 33 and 34 are in communication with unsealed portion 23 through conduits 31 and 32, respectively.

In accordance with the present invention, a plurality of puckers 35 and 37 are located in conduits 31 and 32 and extend between lower heat-sealed portion 30 and upper heat-sealed portions 21 and 22. Puckers 35 are interspersed with puckers 37. As can be seen from FIGS. 4, 5 and 8, the puckers cause the side wall portions 11 and 12 to assume a sinuous configuration and cause portions of the side walls 11 and 12 causing the puckers to lie in contiguous touching relationship. Thus, each pucker 35 and 37 is in effect a valve which is normally closed to prevent atmospheric air from passing through unsealed areas 33 and 34, conduits 31 and 32, and then passing through unsealed area 23 to enter chamber 19. However, when the pressure of gases, whether produced by the aging of the product or by microwaving, exceeds a predetermined pressure, such gases will pass through unsealed area 23, force open the valving produced by the puckers 35 and 37 and pass through the unsealed areas 33 and 34 to the atmosphere. At this time it is to be noted that the very bottom edges 11' and 12' of walls 11 and 12, respectively, are not sealed to each other.

The spacing between sealed area 30 and sealed areas 24 and 25 can be varied to thereby vary the pressure at which the valving produced by the puckers will open. For example, if this spacing is made larger, the valving will open at a lower pressure and if it is made smaller, the valving will open at a higher pressure. Similarly, the unsealed portions 23, 33 and 34 may also be varied in size to affect the pressure at which gases will be discharged from chamber 19.

The walls 11 and 12 are relatively thin, about 1.75 mils. However, this thickness may vary within reasonable limits, but they should be sufficiently thin so that they can pucker, as described above. The puckers 35 and 37 are produced incidental to the formation of heat-sealed areas 20 and 30 and occurs because of the application of heat to the relatively thin flexible polyethylene plastic sheeting being sealed. It will be appreciated that the heat seals t the bottom of bag 10 can be varied in configuration.

If the bag 10 is used for a product which contains a liquid or which otherwise requires venting only during microwaving, a sealing tape (not shown) can be applied entirely across edges 11' and 12' to prevent leakage during storage but which is to be removed prior to microwaving to permit venting.

While the preceding description has defined the sealed areas as being heat sealed, it will be appreciated that other sealing techniques which form puckers are considered within the scope of the present invention.

In certain applications it may be desirable to use a polyethylene film which contains 2%-8% of ethyl vinyl acetate (EVA) for one or both of the walls. This will cause the walls to be sufficiently porous to breathe and thus interchange oxygen and carbon dioxide with the atmosphere at a controlled rate. This is especially desirable when the produce in the bag is a cut or shredded vegetable or a mixture thereof having cut surfaces which excite the enzymes therein to give off relatively large amounts of carbon dioxide. The ability of the bag to breathe through its porous walls permit a controlled small amount of oxygen to enter the bag from the atmosphere, and this oxygen prolongs the fresh flavor of the cut vegetables, but the amount of oxygen is not sufficiently great so as to produce excessive oxidation which would cause browning and breakdown of the vegetables which results in decay. However, since the bag can be vented through the above-described structure, it will not become bloated. Thus a bag having the disclosed venting structure and walls of polyethylene with EVA will provide the above-discussed advantages. Furthermore, the EVA polyethylene comes in different grades, depending on the EVA content, which permits the amount of breathing to be matched to the contents of the bag. Suitable EVA polyethylene is obtainable in various grades from companies such as Dupont, USI, Exxon and Chevron. It will be appreciated that other films which provide controlled breathing may also be used.

While preferred embodiments of the present invention have been disclosed, it will be appreciated that it is not limited thereto but may be otherwise embodied within the scope of the following claims.

What is claimed is:

1. A plastic bag with integral venting structure therein comprising flexible plastic front and rear walls having side edges and ends, means sealing said front and rear walls along said side edges, and means joining said front and rear walls for permitting venting therebetween from the inside of said bag to the atmosphere, said last-mentioned means comprising spaced first and second sealed portions defining a conduit therebetween for venting of gases from said bag, first and second unsealed portions associated with said first and second sealed portions, respectively, at opposite ends of said conduit, and means formed by puckering said front and rear walls in said conduit and causing said front and rear walls between said first and second sealed areas to lie in contiguous contacting engagement and to thus function as normally closed valve means which prevent atmospheric air from entering said bag through said conduit but which will open to permit pressurized gases to be vented from said bag through said first and second unsealed portions and said conduit, at least one of said plastic walls comprising polyethylene which contains ethyl vinyl acetate to permit controlled breathing therethrough.

2. A plastic bag having a venting structure therein comprising flexible plastic front and rear walls having a central product-receiving chamber therebetween and having first and second ends and opposite side edges, means sealing said first and second side edges, an opening between said front and rear walls at said first end defining the mouth of said bag which is subsequently sealed after said bag receives product therethrough from which gases may be generated, first and second spaced elongated sealed areas proximate said second end sealing said front and rear walls to each other, a first unsealed portion between said front and rear walls in contiguous relationship to said first elongated sealed area for permitting gases to pass outwardly from said central product-receiving chamber, a second unsealed portion between said front and rear walls in contiguous relationship to said second elongated sealed area for permitting gases which have passed through said first unsealed portion to pass beyond said second elongated sealed area into the atmosphere, said first and second elongated sealed areas being spaced from each other to define a conduit therebetween to effect communication between said first and second unsealed portions, a plurality of puckered areas in said conduit formed by adjacent portions of said front and rear walls, each of said puckered areas constituting a valve for normally remaining closed to prevent gases from passing into said central product-receiving chamber from the atmosphere through said first and second unsealed portions and said conduit, and each of said valves being openable in response to the pressure of gases generated by the product in said central chamber which is greater than the force holding said valves closed to thereby permit gases generated by said product within said central cavity to pass into the atmosphere through said first and second unsealed portions and said conduit, at least one of said plastic walls comprising polyethylene which contains ethyl vinyl acetate to permit controlled breathing therethrough.

* * * * *